US005158256A

United States Patent [19]

Gross

[11] Patent Number: 5,158,256

[45] Date of Patent: Oct. 27, 1992

[54] KEYBOARD ACCESSORY

[75] Inventor: Clifford M. Gross, Roslyn, N.Y.

[73] Assignee: Biomechanics Corporation of America, Melville, N.Y.

[21] Appl. No.: 630,000

[22] Filed: Dec. 19, 1990

Related U.S. Application Data

[63] Continuation-in-part of Ser. No. 436,704, Nov. 15, 1989, Pat. No. 5,004,196.

[51] Int. Cl.[5] ..... B43L 15/00

[52] U.S. Cl. ..... 248/118.3; 248/298; 248/297.3; 400/715

[58] Field of Search ..... 248/118.3, 118, 118.1, 248/918, 298, 287, 297.3, 245, 246, 297.2; 400/715

[56] References Cited

U.S. PATENT DOCUMENTS

| | | | |
|---|---|---|---|
| 481,293 | 8/1892 | Bailey | 248/287 |
| 1,277,169 | 8/1918 | Anderson | 218/118.3 |
| 1,335,446 | 3/1920 | McDaniel | 248/297.2 X |
| 2,766,463 | 10/1956 | Bendersky | 248/118 |
| 2,767,951 | 10/1956 | Cousino | 248/245 |

FOREIGN PATENT DOCUMENTS

| | | | |
|---|---|---|---|
| 42022 | 7/1964 | Fed. Rep. of Germany | 248/118 |
| 2430036 | 1/1976 | Fed. Rep. of Germany | 400/715 |

*Primary Examiner*—Alvin C. Chin-Shue
*Attorney, Agent, or Firm*—Leonard Bloom

[57] ABSTRACT

A pad support for each wrist of a keyboard operator which is adjustable vertically, transversely and in pivotal traverses relative to the keyboard to minimize unsupported wrist and arm movements of the operator that contribute to fatigue and possible physical injury, such as Carpal Tunnel Syndrome.

20 Claims, 8 Drawing Sheets

KEYBOARD ACCESSORY

CROSS-REFERENCE TO RELATED APPLICATIONS

This application is a continuation-in-part of co-pending application Ser. No. 436,704 filed Nov. 15, 1989, U.S. Pat. No. 5,004,196 issued Apr. 2, 1991 the disclosure of which is incorporated by reference herein in its entirety.

FIELD OF THE INVENTION

The present invention relates generally to improvements for keyboard operators, and more particularly to wrist supports for such operators which contribute to user comfort and obviate the cumulative negative effects of the repetitious movements in the wrists and arms of the operator that otherwise might cause physical injury as well as cause operator fatigue.

BACKGROUND OF THE INVENTION

In many organizations, wrist injury has become a major occupational health problem. An example is Carpal Tunnel Syndrome ("CTS"), one of the most frequently occurring cumulative injuries of the wrist. The carpal tunnel is a narrow fibrous tunnel, which is located on the palmar aspect of the wrist between the distal wrist flexion crease and, roughly, the center of the ulnar border of the thenar muscle mass.

Ten structures pass through the canal —four flexor superficialis tendons (flexor digitorum profundus tendons), the flexor pollicis longus tendons and the median nerve. The median nerve contains fibers from C5 to T1 spinal nerves with contributions from the upper, middle, and lower trunks of the brachial plexus. A part of the lateral and the medial brachial plexus cord combine to form the median nerve. The median nerve passes through the carpal tunnel as it supplies the hand. Distal to the carpal tunnel, the median nerve supplies a motor branch to the thenar muscles, flexor pollicis, and opponens pollicis muscles. Motor branches also supply the lateral head of adductor pollicis and the lumbrical muscles of the index and middle fingers.

Underlying the present invention is the recognition that repetitive and forceful flexion or extension movements of the wrist will gradually damage the median nerve in its narrow canal and lead to the increase of carpal canal pressure either by decreasing the diameter or by increasing the volume of contents of the tunnel. The use of the within inventive keyboard accessory has been found in practice to obviate Carpal Tunnel Syndrome in keyboard operators.

In the U.S. Pat. No. 360,529 issued to Jurey on Apr. 5, 1987, the wrists of a keyboard operator are projected through support loops C, supported from above on a frame A; and while supporting the weight of the wrists, the provided loops are uncomfortable, and to the extent that they resemble "shackles" are undesirable for modern usage.

In U.S. Pat. No. 591,800 issued to Finnblade et al on Oct. 12, 1897, wrist supports for a piano player are arranged for sliding movement on a transverse bar "d", but otherwise the individual wrist supports have no other degrees of movement, such as vertically ascending and descending movements, pivotal movements, or rotative movements, although position adjustments in the bar "d" are contemplated to partially overcome this shortcoming.

In U.S. Pat. No. 1,277,169 issued to Anderson on Aug. 27, 1918, a pair of arc-shaped hand rests are disclosed. Each hand rest has adjustable clamps to permit clamping of each hand rest to the front bar of a typewriter frame or to the edge of a table on which the typewriter is supported. Lateral movement of the hand rests is possible only by adjustment of set screws. The arm rests are connected to rods which have set screws thereon to permit vertical adjustment. The hand rests are flat and do not conform to the shape of the hand and the wrist.

In U.S. Pat. No. 1,801,669 issued to Hintz et al on Apr. 21, 1931, there is disclosed a hand rest for a typist which attaches to front bar frame of the typewriter. The hand rest is a single broad plate which extends the length of the typewriter. Neither horizontal, vertical nor pivotal movement of the hand rest is disclosed nor suggested.

In German patent 1,913,287 issued to Stegmann on Sep. 17, 1970, a typewriter attachment is disclosed having a base plate on which the typewriter rests. Two arms extend outwardly from the edges of the base plate, and threaded rods extend upwardly from each arm. A connecting rod is disposed between the threaded rods, and a broad cross-bar is received on the connecting rod. The single cross bar, serving as a support for the forearm of the user, can be vertically adjusted and can pivot about the connecting rod; but there is no lateral adjustment.

In German patent 2,430,036 issued to Coenen on Jan. 8, 1976, there is disclosed an arm support for typists which has a base on which a typewriter is disposed. A support extends from the base, and a vertically adjustable threaded rod is received in a complementary threaded nut, the nut being welded to the support preventing lateral movement. The top of the threaded rod is connected to an arm cushion which supports the entire forearm of the user, from the wrist to the elbow. This configuration increases stress on the flexor muscles in the forearm. The arm rest is not laterally adjustable with respect to the typewriter.

The applicant is also aware of the following references which are directed to arm rests for keyboards:

| Inventor(s) | Patent No. |
|---|---|
| Springer | 4,621,781 |
| Fowler et al | 4,688,862 |
| Berke | 4,913,390. |

However, none of the known references have considered the ergonomics involved in a person's using a keyboard. These references have not attempted to obtain a "transparent interface" between the user and the keyboard so that the user is operating at maximum efficiency and minimal fatigue and discomfort. The stress on the muscles of the forearm and ulnar deviation of the wrists have not been considered. In fact, most of the devices disclosed in the references aggravate the stress, rather than providing relief.

Accordingly, a keyboard accessory is needed so that the user and the keyboard cooperate as a single unit. In achieving this desired unity between the keyboard and its accessory, the anatomical operation of the fingers, the wrist and the arm muscles should be taken into account and integrated with knowledge of the movement of the anatomical members during keying operations. Further, consideration should be given to persons of varying heights and postures as well as keyboards of varying designs. In summary, a need exists for a device wherein ergonomics is a common denominator to integrate these factors to provide multiple degrees of freedom to the keyboard operator and to minimize stress on the wrists.

SUMMARY OF THE INVENTION

Accordingly, an object of the present invention is to provide universally positionable keyboard operator wrist supports overcoming the foregoing and other shortcomings of the prior art, and more particularly wrist supports of the nature noted in which position adjustments in all the necessary degrees of movement or orientation to the keyboard are readily provided using constructions that are noteworthy by their simplicity and operating mode, as well as providing other benefits and advantages as will be better understood as the description proceeds.

A further object of the present invention is to provide a keyboard accessory which is ergonomically designed to reduce stress and fatigue.

A still further object of the present invention is to provide a keyboard accessory having wrist supports which are adjustable in several dimensions by use of one hand.

A yet further object of the present invention is to provide wrist pads to support the wrists and hand of the keyboard operator which reduce stress and ulnar deviations on the wrist while keying.

In accordance with the teachings of the present invention, there is provided a wrist support apparatus to provide support and comfort and to reduce fatigue and possible injury to the wrists of a keyboard operator The support includes a platform having a substantially flat upper surface on which a keyboard is supported. The platform has a front side having a length thereto. At least one wrist support is provided. Means are provided for mounting the at least one wrist support on the front side of the platform. Means are provided for vertically adjusting the at least one wrist support to a desired vertical position with respect to the keyboard. The front side of the platform has therein a slot extending substantially the length of the front side. The slot has a plurality of spaced-apart detent means adjacent thereto. The at least one wrist support has means thereon to disengage and engage the detents as desired such that the wrist support may be moved slidably and incrementally and retained at a desired lateral position with respect to the keyboard. The wrist support has a wrist pad on an upper end thereof, the wrist pad supporting the wrist and the heel to the hand of the keyboard operator. The wrist pad has a shape complementary to the hand and wrist of the keyboard operator. The means for vertical and lateral adjustment of the wrist support, respectively, is operable by one hand of the keyboard operator.

In a preferred embodiment, a pair of wrist supports are provided having four modalities of lateral adjustment available to the keyboard operator. First, the operator may secure both wrist supports at desired fixed positions with respect to one another and with respect to the keyboard. Second, the operator may secure the one wrist support in a fixed position allow the other wrist support to "float" or slidably move laterally of the keyboard. Third, and vice versa, the operator may slidably move the one wrist support and secure the other wrist support in a fixed position. Fourth, both wrist supports may "float" or slidably move independently of one another, as desired by the operator.

The description of the invention which follows, together with the accompanying drawings should not be construed as limiting the invention to the examples shown and described because those skilled in the art to which this invention appertains will be able to devise other forms thereof within the scope of the appended claims.

BRIEF DESCRIPTION OF THE DRAWINGS

FIG. 13A is a perspective view showing the left wrist support secured in a desired position and the right wrist support laterally movable.

FIG. 13B is a perspective view showing the right wrist support secured in a desired position and the left wrist support laterally movable.

FIG. 13C is a perspective view showing both the right and the left wrist supports laterally movable.

DESCRIPTION OF THE PREFERRED EMBODIMENTS

Figure 1:
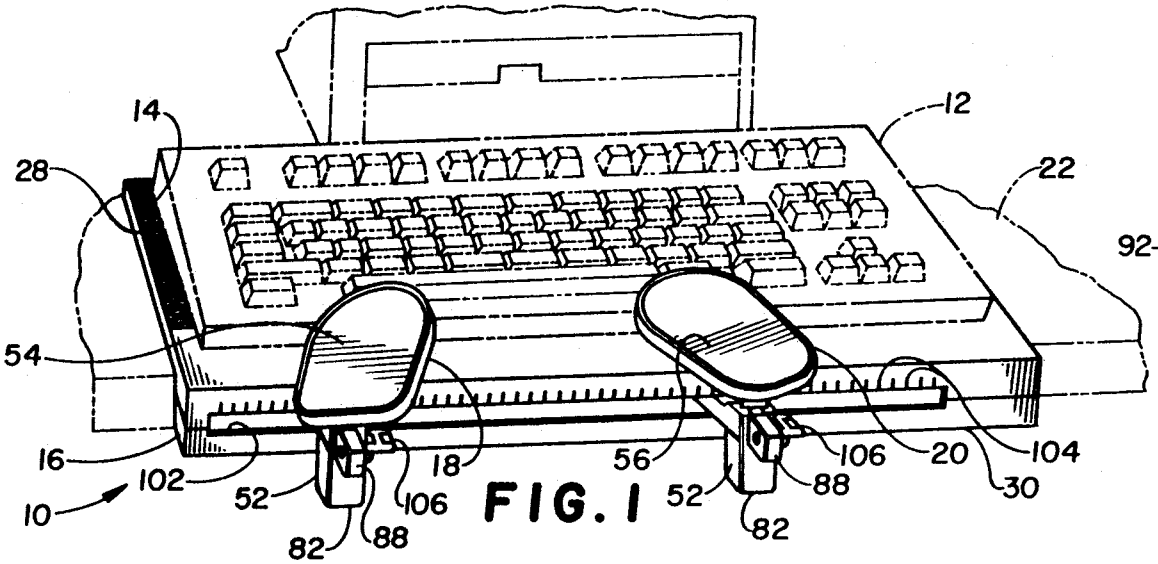
FIG. 1 is a perspective view of the within inventive wrist support and of its operative position in relation to a keyboard shown in phantom perspective.

The within inventive wrist support, generally designated 10, has the operative position as shown in FIG. 1 in which it is used to overcome the tedium of those that operate computers or other keyboard controlled equipment for extended periods, and to achieve this end is located along the front of the keyboard 12.

Figure 2:
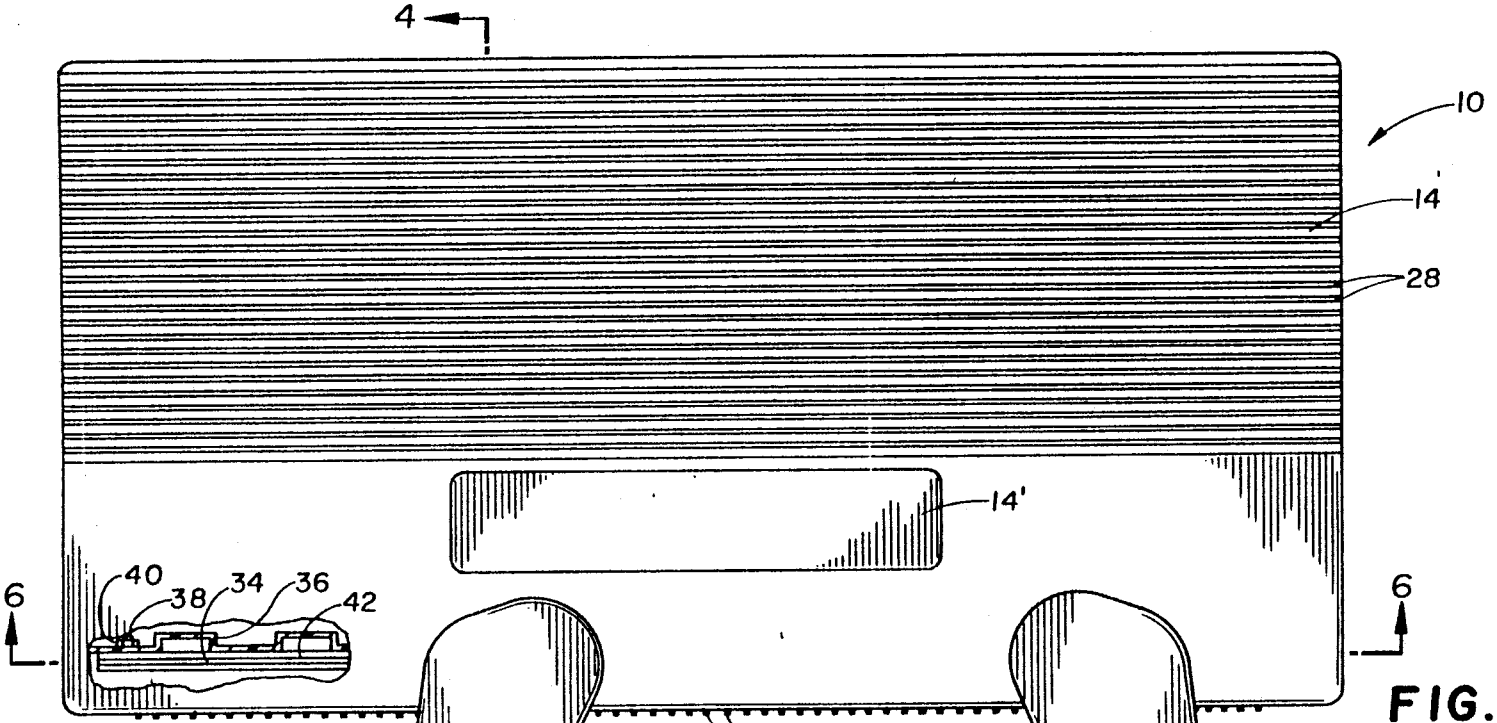
FIG. 2 is a plan view of the wrist support.

Support 10 is comprised generally of a rectangular platform 14 which has a housing 16 along the forward edge of the front position of the housing 16. A section 14' of panel 14 beneath the keyboard 12 may be reserved for operator instructions, as shown in FIG. 2. Protruding from housing 16 are a left wrist support 18 and right wrist support 20, the construction and operation of which will be subsequently described in detail. Platform 14 and housing 16 are designed to fit on the edge of a desk or table 22. Platform 14 optionally can have keyboard 12 merely resting on it, as shown, or it can be attached to keyboard 12, or it can be made integral with keyboard 12. In a preferred embodiment, support 10 is adapted to be secured by Velcro strips 24 which align with Velcro patches 26 adhesively attached to surface 22 to retain its illustrated operative position. Other means of attachment may be used, the securing means is not limited to Velcro fasteners. A ribbed surface 28 on platform 14 assists in the positioning of the keyboard 22. To provide the front slot 102 of the support, the lower part 30 of housing 16 is secured by screws 32, as seen in FIG. 4.

Figure 6:
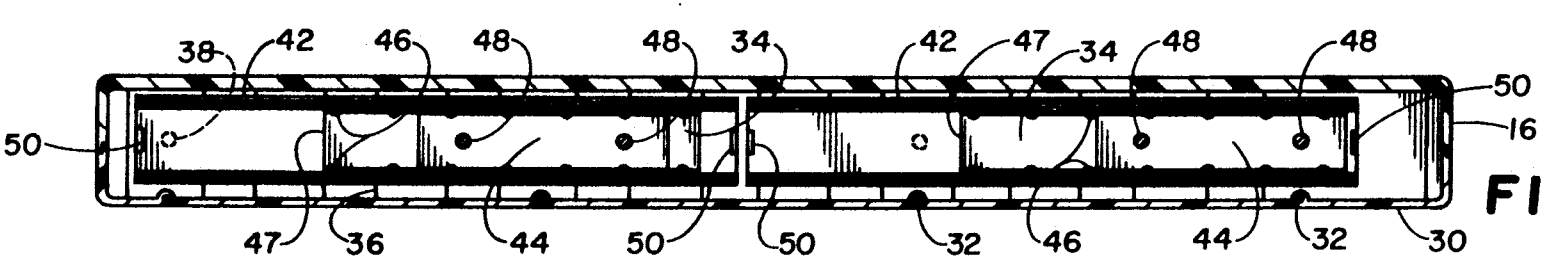
FIG. 6 is a front view in section taken along line 6—6 of FIG. 2.
Figures 4, 5:
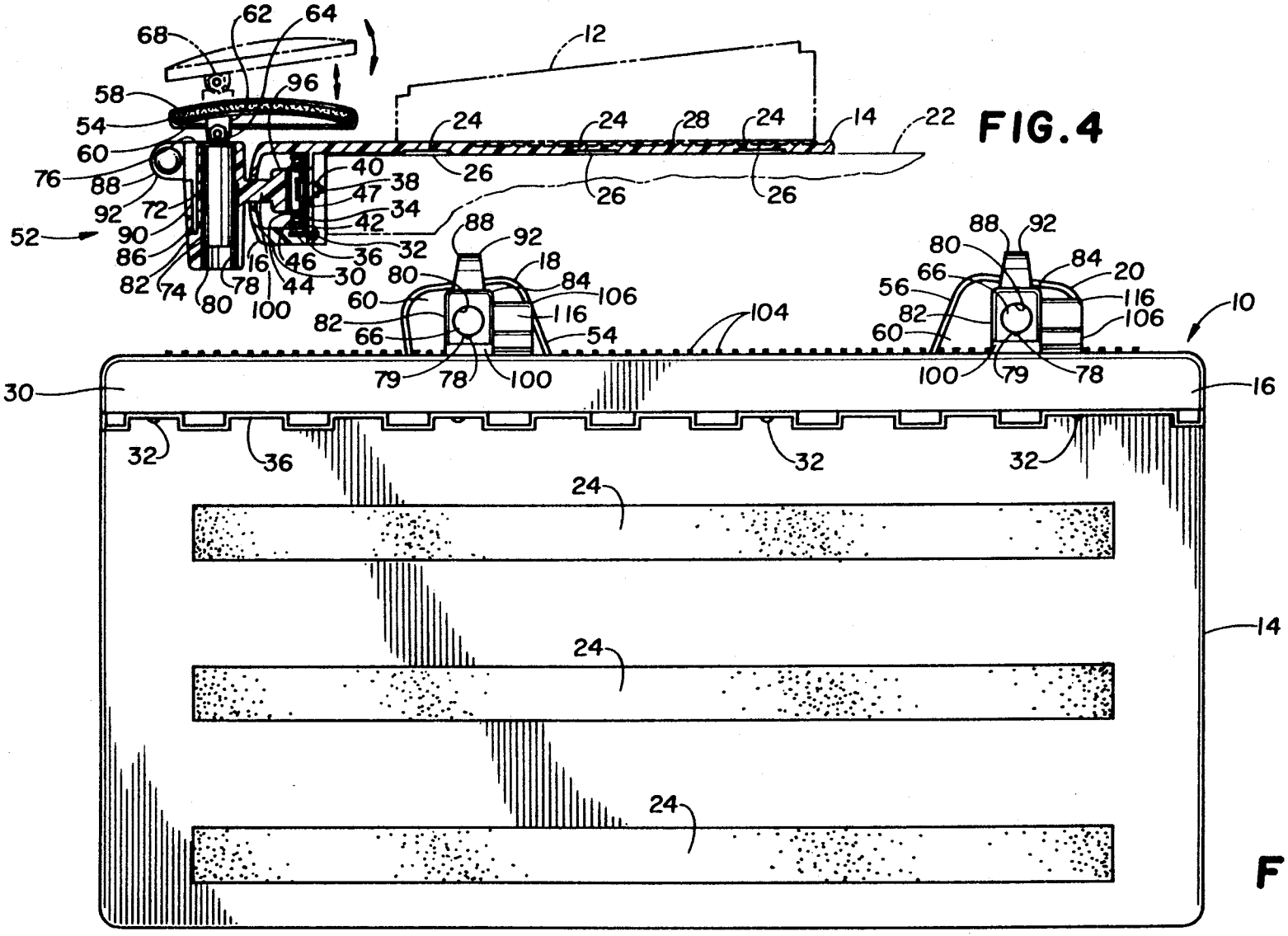
FIG. 4 is a side view in section taken along line 4—4 of FIG. 2.
FIG. 5 is a bottom view of the wrist support.

Within housing 16, and as best seen in FIGS. 4 and 6, in a preferred embodiment, the means for mounting the left and right supports 18, 20 for sliding movement, includes a pair of glide assemblies 34 that are each fastened to a corrugated rear wall 36 by threaded studs 38 and nuts 40. Each assembly 34 has an outer ball bearing race 42 which is stationary while an inner movable ball bearing race carriage 44 is supported on captive ball bearings 46. Ball bearings 46 are held in a retainer 47 by being seated in a cooperating opening smaller than the diameter thereof, and thus in a conventional well understood manner. Each carriage 44 is made to have a pair of threaded studs 48 thereon. The sliding traverse of each carriage 44 is limited by end stops 50 on the stationary race 42. The means for lateral sliding movement of the wrist supports 18, 20 is not limited to the glide assemblies 34 but may be other means well known to those skilled in the art.

Figure 10:
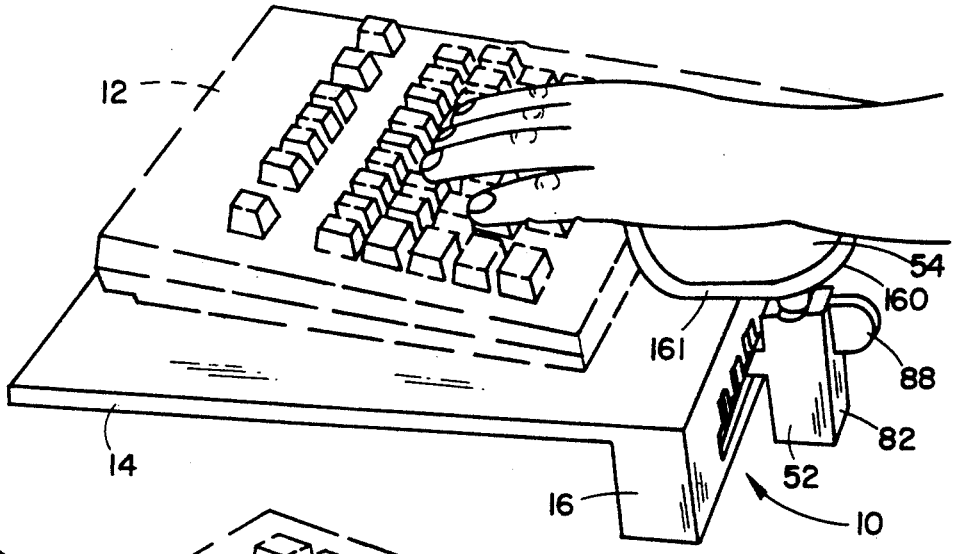
FIG. 10 is a cut-away perspective view showing the disposition of the hand and wrist on the wrist pad.
Figure 14:
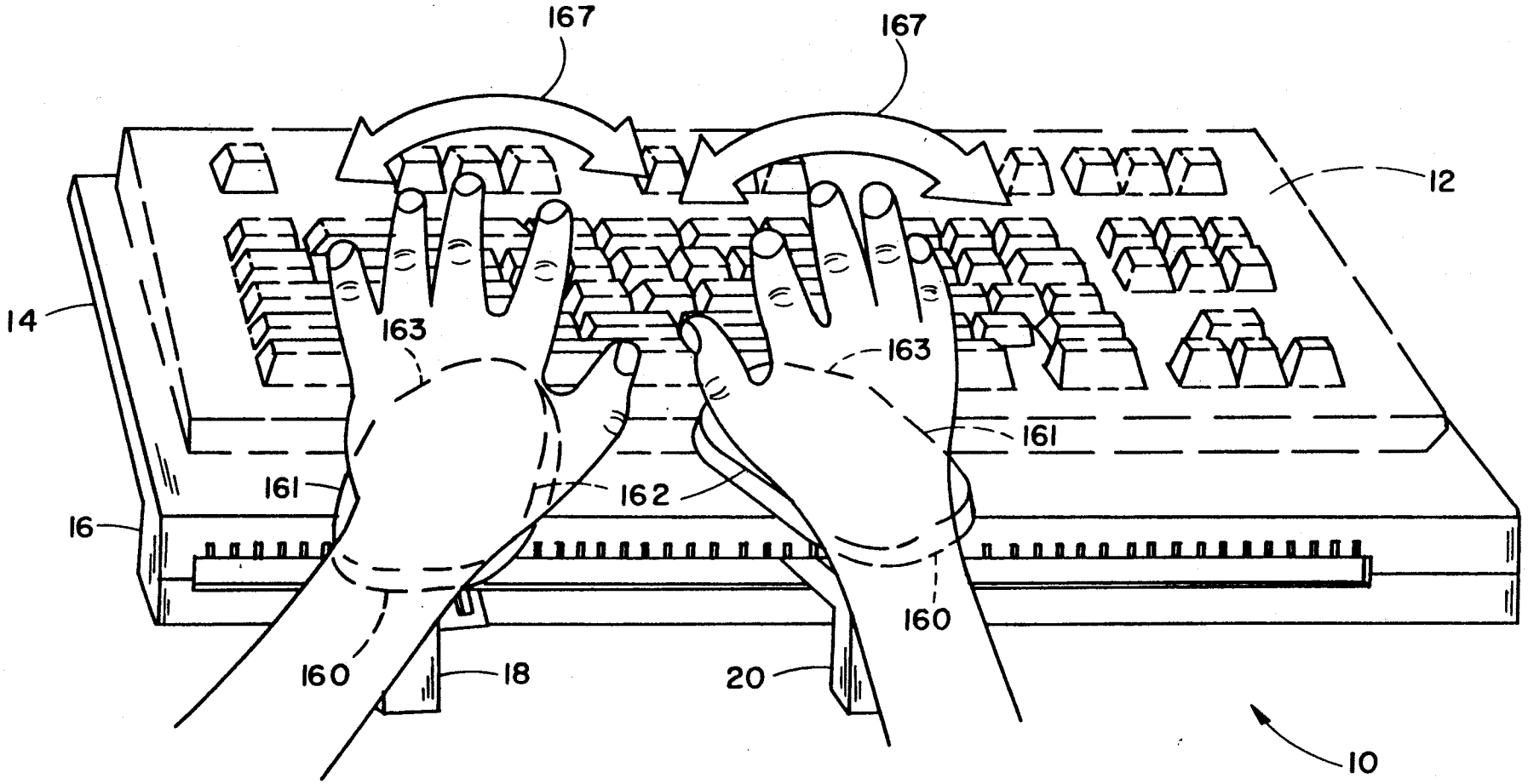
FIG. 14 is a top plan view showing the operator's hands on the wrist pads.

Attached to each carriage 44 is a wrist support assembly or member 52 for each wrist support 18 and 20. Both assemblies 52 are identically constructed except for the curvature of the left and right wrist pads 54 and 56, which are each made of a foam filled, soft, flexible, plastic cover 58 fitted to a shaped metal plate 60 (FIG. 4). The padded nature of the wrist pads 54, 56 absorb the pressure on the hands when keying and also distribute the load of the hand on the respective pad. Preferably, the cover 58 is a visco elastic polymer with a skin-like texture which provides comfort to the keyboard operator and reduces slippage of the operator's wrist on the convex surface of the pad. The shape of the wrist pads 54 and 56 is designed to reduce stress on the wrists of the keyboard operator. As shown in FIGS. 2, 10 and 14, the wrist pads 54 and 56 support the wrist and the heel of the hand of the user and complement the natural anatomical curvature thereof to reduce pressure on the carpal tunnel. Each wrist pad 54, 56 has substantially a four-sided shape with rounded corners. A first side 160 oriented toward the keyboard operator and away from the keyboard is substantially straight. A second side 161 is substantially perpendicular to the first side 160 and is disposed toward the respective outer side of the support 10. The third side 162 is disposed o the inner side of the respective wrist pads 54, 56 and opposite the respective second side 161 such that the respective third sides 162 of the wrist pads 54, 56 are in a facing relationship with one another. The respective third side 162 forms an obtuse angle with the respective first side 160. The fourth side 163, opposite the respective first side 160 is oriented toward the keyboard. An obtuse angle is formed between the respective second side 161 and the respective further side 163 such that the inner edge of the fourth side 163 is closer to the keyboard than is the outer edge of the fourth side 163. The fourth side 163 is connected to the third side 162 by an arcuate edge which forms a bulge oriented in the direction of the keyboard. In this manner, when the hand of the keyboard operator is rested on the respective wrist supports 54, 56, the little finger of the hand is disposed toward the respective second side 161 and the index finger is disposed above the arcuate edge of the fourth side 163. As shown in FIG. 10, support is provided to the heel of the hand to distribute the load from the heel of the hand. The edges of the respective pads 54, 56 are tapered so as not to interfere with movements of the fingers while keying. The wrist of each hand is supported by the respective first sides 160 of the wrist pads 54, 56. The wrist pads 54 and 56 are cambered inwardly toward one another to correspond with the natural disposition of the arms of the keyboard operator positioned in front of the keyboard. This further reduces stress on the arms, shoulders and neck of the keyboard operator. The camber of the wrist pads 54, 56 has been determined using electromyographic (EMG) signals of the muscle activity of the forearms so that minimal stress is applied to these muscles.

Figure 7:
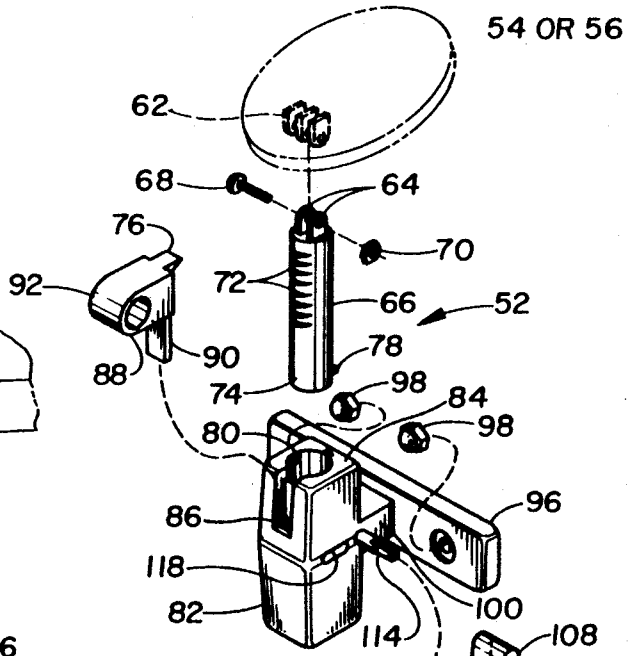
FIG. 7 is a perspective view of the main components of the wrist support in disassembled relation to better illustrate the cooperative relation therebetween.

Referring to FIG. 7 in conjunction with FIG. 4, it will be noted that each plate 60 has three hinge leaf extensions 62 on its lower surface that interfit in engaging relation with a pair of similar extensions 64 on support post 66. Extensions 62 and 64 allow for pivotal movement except when frictionally prevented by a screw 68 and self-locking nut 70. In this manner, screw 68 and nut 70 can be tightened to lock pads 54 and 56 in any position, or untightened to give a degree of pivotal freedom preparatory to permitting adjustment to another position. Post 66 is provided with a series of notches 72 on its forward face 74 that are engaged by a pawl 76. A detent key 78 on the post rear face 79 limits it only to vertical movement within bore 80 of bracket member 82.

Figure 11:
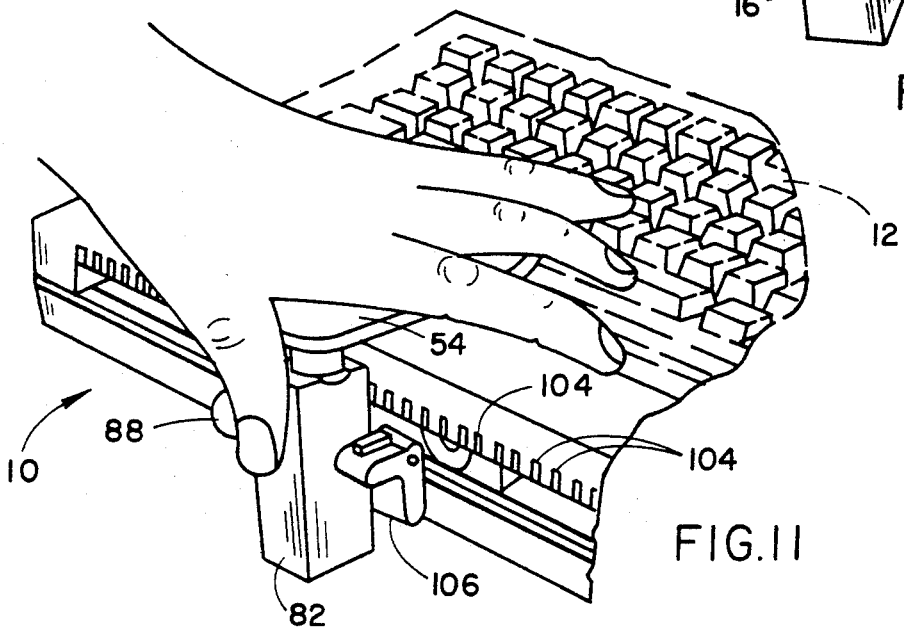
FIG. 11 is a cut-away perspective view showing one hand of the operator adjusting a wrist support.

Bracket 82, made of plastic or metal, has a rectangular collar section 84 about bore 80, the forward wall of which is notched, as at 86, to provide a seat for a vertical adjustment member 88 for the post 66. Member 88, made of semi-hard plastic, has a dependent arm 90 which acts as a leaf spring, and thus is normally under spring bias against post 66 and thus normally urges pawl 76 into one of the notches 72. Member 88 is also provided with a finger grip 92 which allows the user to pull member 88 away from post 66, thereby releasing the biasing force of spring 90, such that the released post 66 can be vertically adjusted to correspondingly adjust the position of the left or right wrist pads 54 and 56. This adjustment can be performed by one hand of the keyboard operator (FIG. 11) further simplifying use of the present invention. After adjustment, release of grip 92 allows member 88 to maintain the selected vertical positions of the pads 54 or 56. Incorporation of the spring 90 adds a further dimension to the reduction of stress to the wrists of the keyboard operator. The spring 90 provides tactile feedback when pressure is applied to the respective wrist pad as the keyboard operator presses on the keys. Also, when keying, the operator may remove the wrist from the wrist pad and then replace the wrist on the pad. The spring 90 absorbs energy and reduces the impact, and consequently the stress, induced in the wrist. For reduction of stress to the keyboard operator, simple vertical adjustment is needed. Operators having differing heights and postures require vertical adjustability to accommodate individual differences and preferences for comfort. A further need for vertical adjustment is due to the non-standard height of the keyboards provided by different suppliers of keyboards. Without having a vertical adjustment, the wrists of keyboard operator would be angled upwardly or downwardly, depending on the particular keyboard, in order to permit the operator's fingers to contact the keyboard. This induces a severe stress on the wrists and the muscles of the forearm. EMG measurements have been used to identify the degree of stress caused by this bending of the wrists and to confirm that the stress is significantly reduced by proper vertical adjustment.

Each collar section 84 is connected by a leg 100 to a mounting panel 96 having holes 94 for receiving therethrough the studs 48 of the ball bearing assemblies 34, which studs are then threadably engaged by cap nuts 98.

Figure 3:
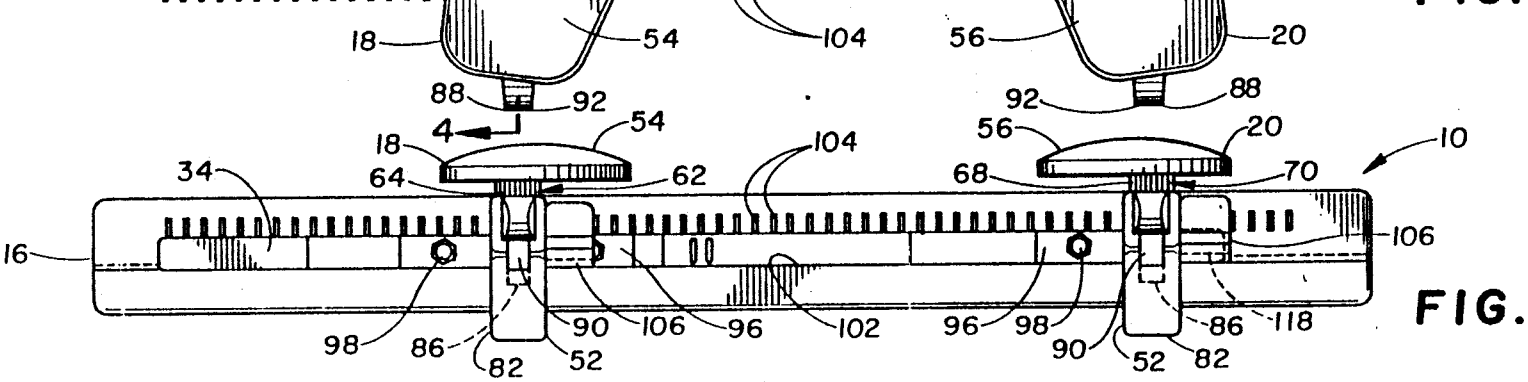
FIG. 3 is a front elevational view thereof.

From the description provided, it should be understood that left support assembly 18 and right support assembly 20 are designed to be vertically adjustable in the manner noted in connection with FIG. 4, and also to be pivotably adjustable about screw 68 and nut 70, again as also noted in connection with FIG. 4, and to have a degree of movement in which each is readily slidable, left or right, along the ball bearing assemblies 34 within housing 16, as previously noted in connection with FIGS. 3 and 6.

Figure 8:
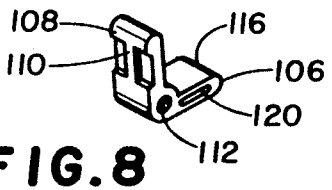
FIG. 8 is an ilosated perspective view of one of the FIG. 7 components, namely the clamp members, but as seen from the rear.
Figure 9:
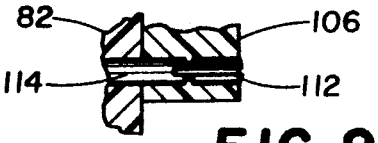
FIG. 9 is a sectional view showing further structural details of the clamp member.

However, there are working conditions, with a number keyboard only, for instance, when the user desires not to have either right or left traversing movements in either wrist support assembly 52. Therefore, above the slot or opening 102 on the front of housing 16, there is provided a series of detents (second detent means) 104 bounding position-locating spaces that are engaged by a clamp member 106 on bracket 82. That is, and as best shown in FIG. 8, a clamp member 106, made of semi-rigid plastic, is provided with a contoured face 108 which is dimensioned to have a center section 110 which fits between two adjacent detents 104 on housing 16 to place the clamp member 106 in its locked or positioning mode. Member 106 pivots about a throughbore 112 on a cantilever pin 114 which extends laterally from bracket 82. Throughbore 112 and pin 114 are designed to be self retaining as shown in FIG. 9 or can be connected in a conventional manner.

Figure 12:
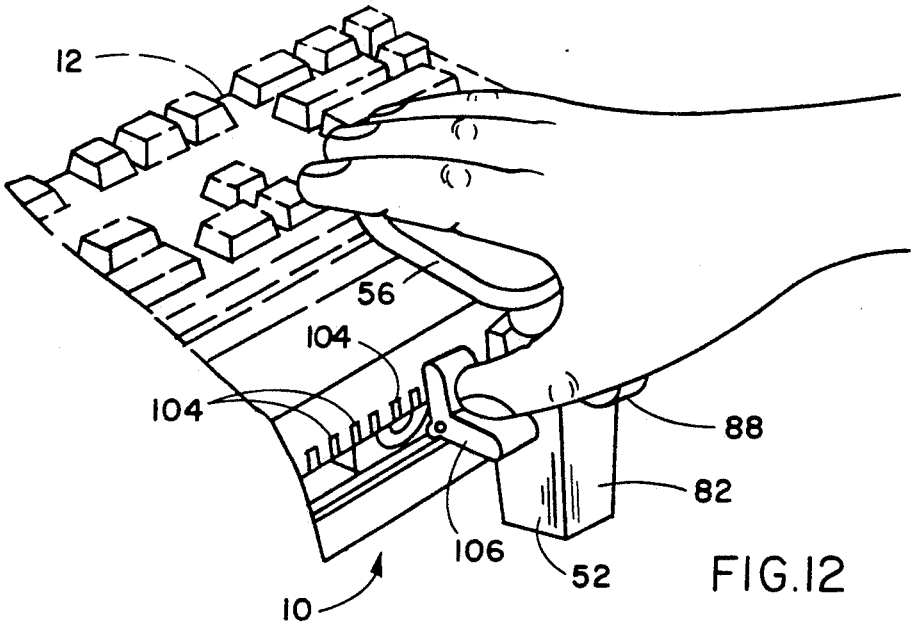
FIG. 12 is a cut-away perspective view showing one hand of the operator adjusting the clamp for lateral movement of a wrist support.

When clamp member 106 is in its disengaged or unsecured mode, wrist supports 18 and 20 are of course free to move transversely. To then lock or secure either wrist support assembly 52, the operator merely rotates clamp 106 about pin 114 by pushing up on handle 116 thereof which brings face 18 against detents 104 allowing the center section (first detent means) 110 to find its place between a selected pair of adjacent detents 104. The means for locking the clamp member 106 to the detent means 104 is not limited to a center section 110 being placed between detents 104 but may be a configuration known to those skilled in the art. This could include the detent means 104 being a plurality of spaced-apart openings and the face 108 having a cooperating protruding means to engage said openings. With any embodiment, clamp 106 is then maintained or locked in place by a detent projection 118 formed on the side of bracket 82 adjacent clamp 106 which projects into a cooperating shaped recess 120 in handle 116. Reversal of the just described procedure involving clamp 106 provides for release of wrist support 52 for sidewise movement. These rotations of the clamp 106 to secure and unsecure the positioning of the wrist support 52 can be performed by one hand of the operator due to the ergonomic design which permits the keyboard operator to reach the clamp 106 while substantially maintaining the position of the hand on the wrist support (FIG. 12).

Figure 13A:
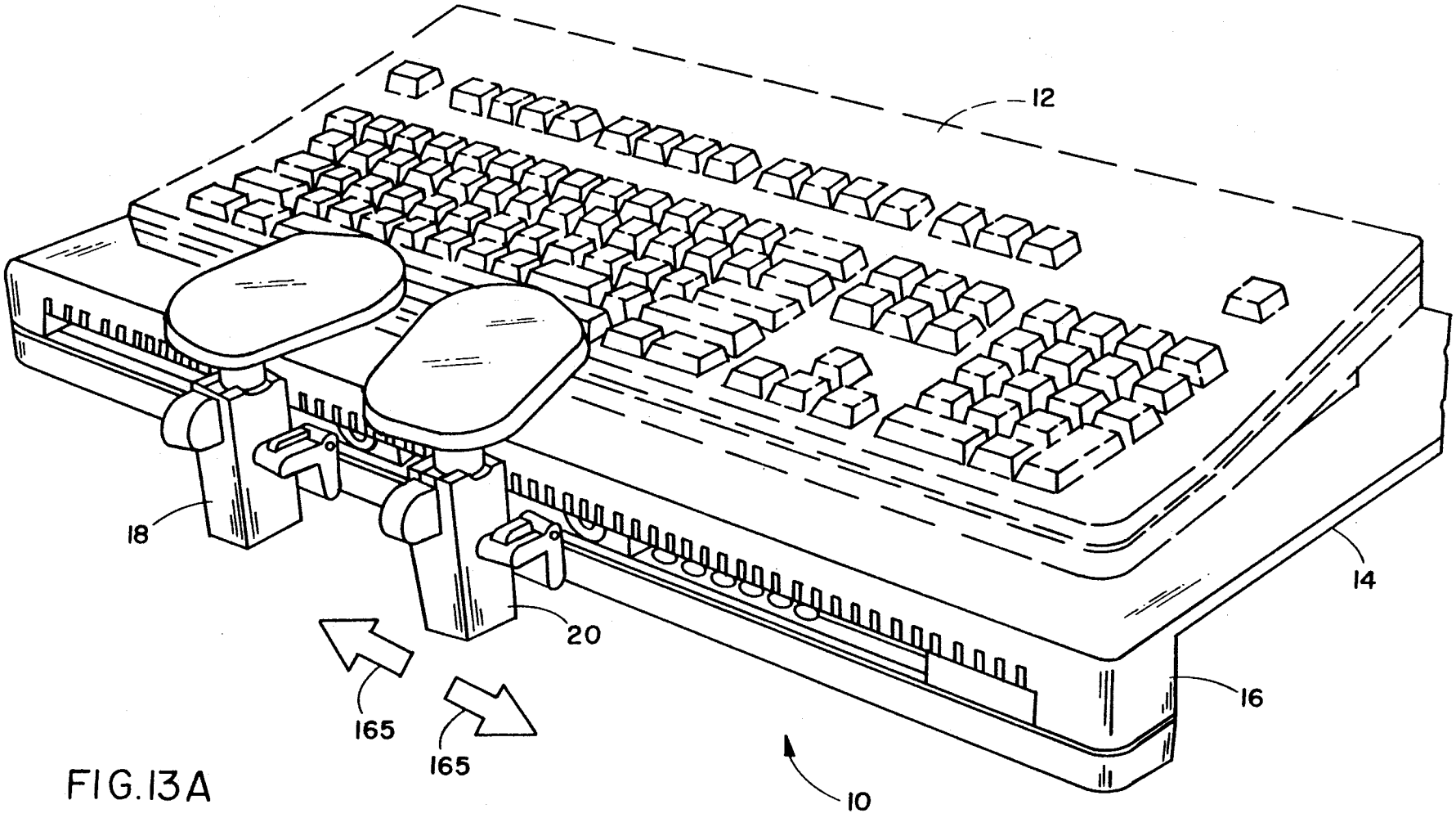
FIGS. 13A–13C are views showing modes of lateral movement of the wrist supports.
Figure 13B:
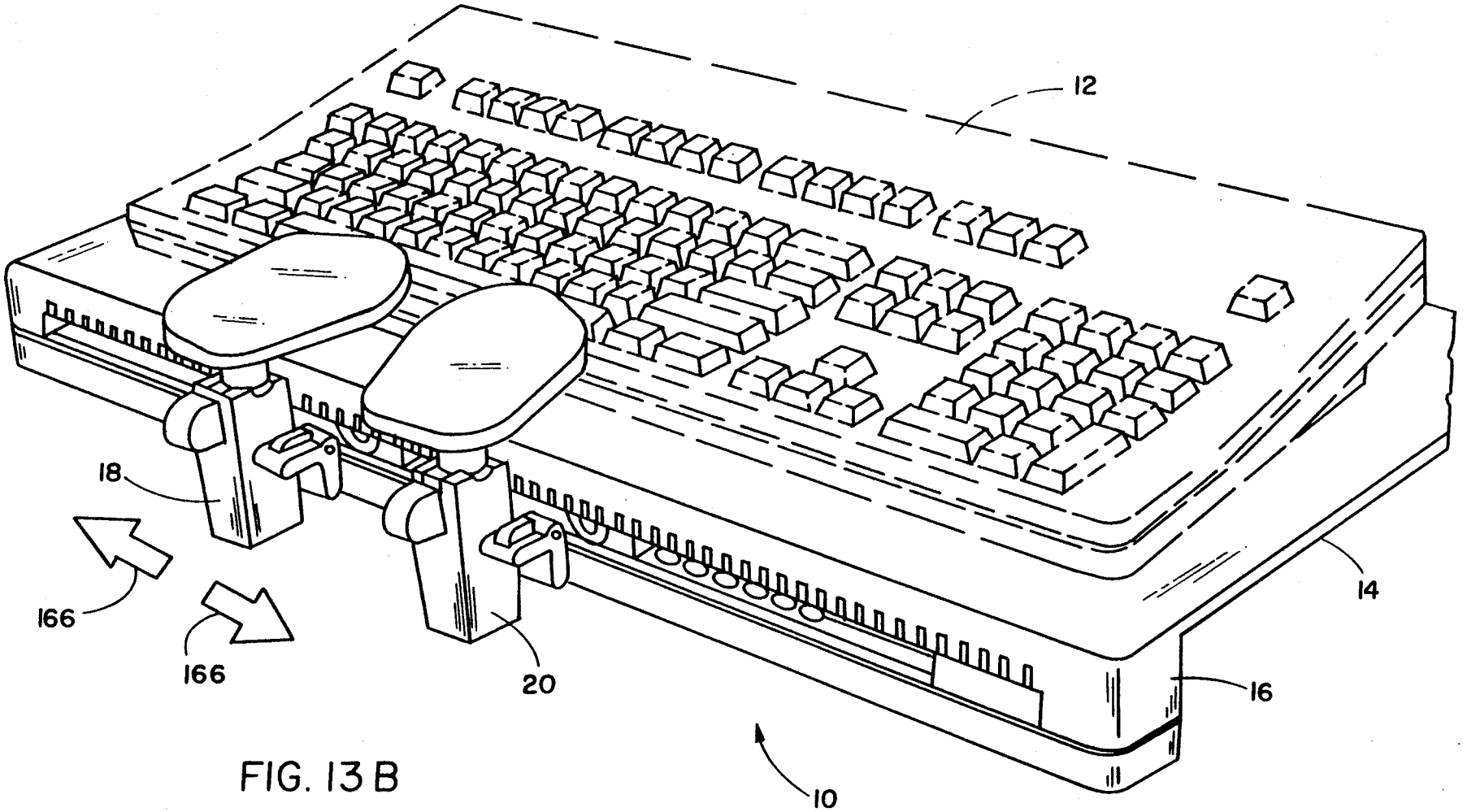
Figure 13C:
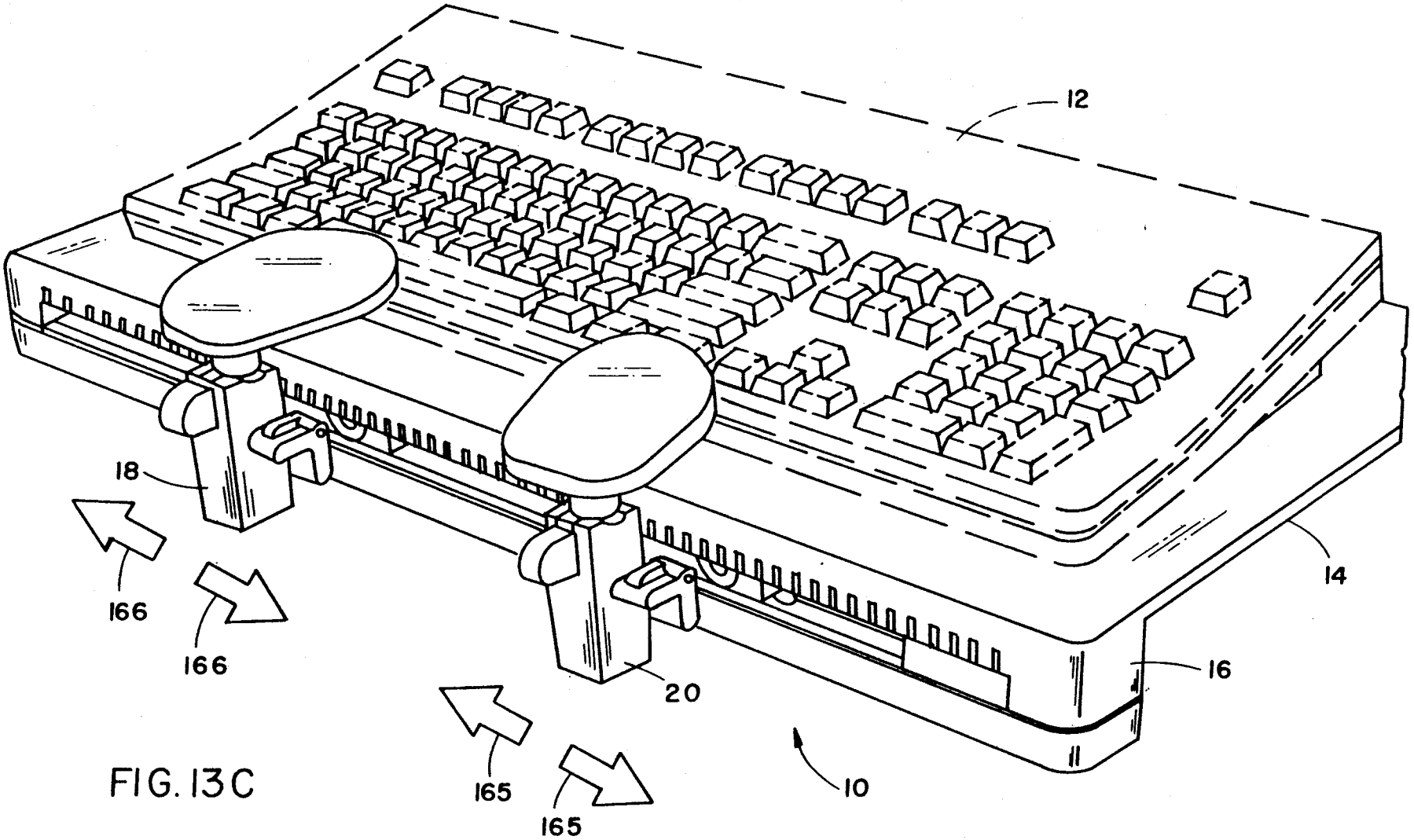

An added degree of versatility is provided by the securing and unsecuring of the separate wrist supports 54, 56 along the series of detents 104 on the length of the housing 16. As shown in FIGS. 11, 13A–13C four modalities of use are provided: (1) the left wrist support 18 and the right wrist support 20 may be secured at desired fixed positions with respect to the keyboard 12 and with respect to one another (FIG. 12); (2) the left wrist support 18 may be secured at a desired fixed position with respect to the keyboard 12 and, while keying, the right wrist support 20 may "float" to suit the individual operator, that is, the right wrist support 20 may be slidably laterally moved along the available length of the housing 16 as shown by the arrows 165 (FIG. 13A); (3) the right wrist support 20 may be secured at a desired position with respect to the keyboard 12 and, while keying, the left wrist support 18 may "float" or may be slidably laterally moved along the available length of the housing 16 as shown by the arrows 166 (FIG. 13B); and (4) the right wrist support 18 and the left wrist support 20 may both "float" or be unsecured so that, while keying, each support may be individually slidably laterally moved as desired by the operator along the length of the housing 16 as shown by the arrows 165, 166 (FIG. 13C).

These modalities provide the keyboard operator with a support means for the wrists which is versatile and reduces stress. The operator selects the mode which is most comfortable and convenient for the type of keying which is required. In the selected mode, the wrist is disposed so that ulnar deviation is minimized. Movement of the wrists to the right and left as shown by arrows 167 (FIG. 14) are indicative of ulnar deviation which produces stress. The present invention permits the keyboard operator to secure or move the individual wrist supports 18, 20 incrementally or in a sliding movement to a position which is most comfortable and least stressful. EMG measurements have confirmed the reduction in muscle stress when the wrist supports are disposed in the selected positions. A feature of the present invention is the maintaining a relatively straight wrist while keying in, thus reducing the amount of wrist flexion and extension involved, which in turn reduces the amount of muscle effort required. Furthermore, there is less fatigue involved with the arms and shoulders once the wrists are supported while keying in.

A further adjustment is provided by the limited pivotal movement of each wrist pad 54, 56 by rotation of the respective post 66 within the respective collar section 84. The rotation is limited by the ability of the pawl 76 to engage the notches 72. A movement of approximately $+/-5°$ about a vertical axis of the respective wrist support ma be obtained. This adjustment permits the keyboard operator to further reduce stress on the wrists due to lateral movement (FIGS. 7 and 14).

For completeness sake it is noted that preparatory to use, means such as "VELCRO" hook-and-loop patches 26 are positioned on surface 22 to hold the support unit 10 in place. Keyboard 12 is then placed on platform 14 at a convenient location with respect to the distance between the keyboard and the wrist supports. The user then adjusts each wrist support assembly 18 and 20, according to instructions 14'. The within inventive support 10 in the manner described contributes to user comfort and obviates the cumulative negative effects of the repetitious movements in the wrists and arms of the operator that otherwise might cause physical injury as well as cause operator fatigue.

While the within inventive wrist support construction herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

What is claimed is:

1. A wrist support apparatus to provide support and comfort and to reduce fatigue and possible injury to the wrists of a keyboard operator using a keyboard, the support comprising: a platform having a substantially flat upper surface on which the keyboard is supported, the platform having a front side having a length thereto; at least one wrist support to support the heel of the hand and the wrist adjoining thereto; means for mounting the at least one wrist support on the front side of the platform; means for vertically adjusting the at least one wrist support to a desired vertical position with respect to the keyboard; said vertical adjusting means being mounted on the at least one wrist support, permitting vertical adjustment by one hand of the keyboard operator a spring mounted on the wrist support, the spring urging the wrist support upwardly against the operator's wrist thereby absorbing energy and providing tactile feedback when pressure is applied to the wrist support by the operator's wrist; the front side of the platform having therein a slot extending substantially the length of the front side, the slot having a plurality of laterally spaced-apart detent means adjacent thereto, and the at least one wrist support having means thereon to disengage and engage the detents as desired, such that said wrist support may be moved incrementally and retained at a desired lateral position with respect to the keyboard said lateral adjustment being performed by one hand of the keyboard operator while maintaining said hand on the at least one wrist support.

2. The wrist support apparatus of claim 1, further comprising the at least one wrist support having a side opposite to the keyboard, a vertical post, a spring-biased finger grip mounted on the at least one wrist support and releasably engaging the vertical post, the finger grip being manually pulled outwardly from the wrist support to disengage the finger grip from the vertical post wherein vertical adjustment by one hand of the keyboard operator is permitted.

3. The wrist support apparatus of claim 1, further comprising the detent means in the slot on the front side of the platform being first detent means, the at least one wrist support further having a member pivotally mounted thereon, the member projecting laterally therefrom, the member being substantially L shaped and including at least one leg having a second detent means, wherein said member may be manually pivoted to permit the second detent means to selectively engage and disengage the first detent means adjacent to the slot on the front side of the platform.

4. A wrist support apparatus to provide support and comfort and to reduce fatigue and possible injury to the wrists of the keyboard operator using a keyboard, the support comprising: a housing mounted adjacent to the keyboard, the housing having a length thereto, a plurality of laterally spaced-apart first detent means being disposed along the length of the housing; a pair of wrist supports to support the heel of the hand and the wrist adjoining thereto, each wrist support having a vertical axis, a wrist pad having a convex upper surface mounted on a respective upper end of each wrist support; a spring mounted on each wrist support, the spring urging the respective wrist support upwardly against the operator's wrist thereby absorbing energy and providing tactile feedback when pressure is applied to the respective wrist support by the operator's wrist; means for connecting the wrist supports to the housing for vertical adjustment of the wrist supports individually with respect to the keyboard and with respect to one another; means for connecting the wrist supports to the housing, each wrist support having a member pivotally mounted thereon, the member projecting laterally therefrom, the member being substantially L shaped and including at least one leg having a second detent means thereon to engage and disengage the first detent means on the length of the housing for incremental lateral adjustment of the wrist supports individually with respect to the keyboard and with respect to one another; said member pivotally mounted on each wrist support to engage and disengage the detent means on each wrist support being pivotably operable by one hand of the keyboard operator while maintaining said hand on the respective wrist support; means for limited pivotal movement about the respective vertical axis of each wrist support with respect to the keyboard and with respect to the other wrist support such that the keyboard operator may adjust each wrist support and each wrist pad individually to a desired position.

5. A wrist support apparatus to provide support and comfort and to reduce fatigue and possible injury to the wrists of a keyboard operator using a keyboard, the support comprising: a housing mounted adjacent to the keyboard, the housing having a length thereto, a plurality of laterally spaced-apart detent means being disposed along the length of the housing, a pair of wrist supports to support the heel of the hand and the wrist adjoining thereto, each wrist support having an upper end, a side opposite to the keyboard and a wrist pad having a convex upper surface on the respective upper end thereof; the wrist pads being cambered inwardly toward one another; each wrist support having a side opposite to the keyboard, a vertical post, a spring biased finger grip mounted on each wrist support on the respective wrist support on the side opposite to the keyboard, the respective finger grip releasably engaging each respective vertical post; means for connecting the wrist supports to the housing for vertical and lateral adjustment of the wrist supports individually with respect to the keyboard and with respect to one another, wherein said vertical adjustments may be made by one hand of the keyboard operator manually pulling the finger grip outwardly from the respective wrist support to disengage the finger grip from the respective vertical post, each wrist support having means pivotally mounted thereon to engage the detent means on the length of the housing wherein each wrist support may be independently disposed incrementally at a desired lateral position with respect to the keyboard and to the other wrist support or to disengage the detent means wherein each wrist support may independently slide continuously laterally to a desired position with respect to the keyboard and to the other wrist support; such that the keyboard operator may adjust each wrist support individually to a desired position.

6. A wrist support apparatus to provide support and comfort and to reduce fatigue and possible injury to the wrists of a keyboard operator using a keyboard, the support comprising: a platform having a substantially flat upper surface on which the keyboard is supported; a pair of wrist supports connected to the platform; wherein the keyboard may be disposed on the platform at a desired distance from the wrist supports, each wrist support having a vertical axis, an upper end, a side opposite to the keyboard, a vertical post; a spring biased finger grip mounted on each wrist support on the respective wrist support on the side opposite to the keyboard, the respective finger grip releasably engaging each respective vertical post; a wrist pad having a convex upper surface mounted on an upper end of each wrist support to support the heel of the heel of the hand and the wrist adjoining thereto, the wrist pads being cambered inwardly toward one another; means connecting the wrist supports to the platform for independently adjusting each wrist support vertically relative to the platform and relative to the other wrist support, wherein said vertical adjustment may be made by one hand of the keyboard operator by manually pulling the finger grip outwardly to disengage the finger grip from the vertical post and means for limited pivotal movement about the respective vertical axis of each wrist support with respect to the keyboard and with respect to the other wrist support such that the keyboard operator may adjust each wrist support and each wrist pad to a desired position.

7. A wrist support apparatus to provide support and comfort and to reduce fatigue and possible injury to the wrist of a keyboard operator using a keyboard, the support comprising: a platform having a substantially flat upper surface on which the keyboard is supported; the platform having a front side extending outwardly from the keyboard, the front side of the platform having a plurality of laterally spaced-apart first detent means thereon, a pair of separable, independent wrist supports connected to the platform to support the heel of the hand and the wrist adjoining thereto, each wrist support further having a member pivotally mounted thereon, the member projecting laterally thereform, the member being substantially L shaped and including at least one leg having a second detent means thereon for laterally adjusting each wrist support wherein the second detent mean son each wrist support may selectively engage and disengage the respective first detent means on the platform permitting incremental, stepwise and sliding movement of each wrist support with respect to the keyboard and with respect to the other wrist support, said pivotally mounted member for laterally adjusting each wrist support being operable by one hand of the keyboard operator while maintaining said hand on the respective wrist support, and a spring mounted on each wrist support, the spring urging the respective wrist support upwardly against the operator's wrist thereby absorbing energy and providing tactile feedback when pressure is applied to the respective wrist support by the operator's wrist.

8. The wrist support apparatus of claim 7, further comprising means for connecting each wrist support to the keyboard for vertical adjustment of each wrist support individually with respect to the keyboard and with respect to the other wrist support, each wrist support having a side opposite to the keyboard, a vertical post, a spring biased finger grip mounted on each wrist support on the respective wrist support on the side opposite to the keyboard, the respective finger grip releasably engaging each respective vertical post, wherein said vertical adjustment may be made by one hand of the keyboard operator by manually pulling the finger grip outwardly from the wrist support to disengage the finger grip from the vertical post.

9. The wrist support apparatus of claim 7, further comprising means for limited pivotal movement about a respective vertical axis of each wrist support with respect to the keyboard and with respect to the other wrist support.

10. The wrist support apparatus of claim 7, wherein four modes of operation are provided, the one wrist support may engage the desired respective detents and be prevented from lateral movement and the other wrist support may be disengaged from the respective detents and slidably moved laterally, the other wrist support may engage the desired respective detents and prevented from lateral movement and the one wrist support may be disengaged from the respective detents and may slidably move laterally, both wrist supports may engage the desired respective detents and be prevented from lateral movement, and both wrist support may be disengaged from the respective detents such that both wrist supports may have unrestricted lateral movement.

11. The wrist support apparatus of claim 7, wherein the pivotally mounted member for laterally adjusting each wrist support is a clamp member mounted on each wrist support, said clamp member being operable by a thumb of the hand of the keyboard operator while said hand is supported by the respective wrist support.

12. A wrist support apparatus to provide support and comfort and to reduce fatigue and possible injury to the wrists of a keyboard operator using a keyboard, the support comprising: a platform having a substantially flat upper surface on which the keybaord is supported; the platform having a front side extending outwardly from the keyboard, the front side of the platform having a plurality of laterally spaced-apart first detent means thereon, a pair of separable, independent wrist supports connected to the platfrom to support the heel of the hand and the wrist adjoining thereto, each wrist support having a side opposite to the keyboard, a vertical post, a spring biased finger grip mounted on each wrist support on the respective wrist support on the side opposite to the keyboard, the respective finger grip releasably engaging each respective vertical post, means thereon for laterally adjusting each wrist support wherein each wrist support may selectively disengage and engage the respective first detent means on the platform permitting sliding and incremental, stepwise movement respectively of each wrist support with respect to the keyboard and with respect to the other wrist support; means for connecting each wrist support to the keyboard for vertical adjustment of each wrist support individually with respect to the keyboard and with respect to the other wrist support, a spring-biased finger grip mounted on each wrist support wherein said vertical adjustments may be made by one hand of the keyboard operator moving the finger grip; each wrist support having a wrist pad on a respective upper end thereof each wrist pad having a convex upper surface; means for limited pivotal movement of each wrist support about a respective vertical axis with respect to the keyboard and with respect to the other wrist support such that the keyboard operator may adjust each wrist support and each wrist pad individually to a desired position.

13. A support apparatus ergonomically designed to provide support for a keyboard operator's hands and wrists, the support comprising a housing mounted adjacent to the keyboard, the housing having connected thereto a pair of wrist supports, each wrist support having a wrist pad on a respective upper end thereof, wherein each wrist pad has four sides, a first side oriented toward the keyboard operator, a second side substantially perpendicular to the first side, a third side opposite the second side and in a facing relationship with the other wrist pad, the third side forming an obtuse angle with the first side, a fourth side opposite to the first side, the fourth side forming an obtuse angle with the second side, a bulge oriented in the direction of the keyboard being formed between the fourth side and the first side, each wrist pad supporting each wrist and the heel of each hand of the keyboard operator, each wrist pad having a shape complementary to the hand and wrist of the operator, the wrist pads being cambered toward one another wherein ulnar deviation is minimized when the operator keys the keyboard and fatigue and injury to the wrists is reduced.

14. The support apparatus of claim 13, further comprising each wrist pad having a cover thereto, each cover being fabricated from a visco elastic polymer.

15. A wrist support apparatus ergonomically designed to provide support and comfort and to reduce fatigue and possible injury to the wrists of a keyboard operator using a keyboard, the support comprising a housing mounted adjacent to the keyboard, the housing having a length thereto, a plurality of spaced-apart first detent means being disposed along the length of the platform; a pair of wrist supports to support the heel of the hand and the wrist adjoining thereto, means for connecting each wrist support to the housing, each wrist support further having a member pivotally mounted thereon, the member projecting laterally therefrom, the member being substantially L shaped and including at least one leg having a second detent means, the second detent means of each pivotally mounted member selectively cooperating with the plurality of spaced-apart first detent means on the housing to maintain each individual wrist support in a desired laterally adjusted position on the length of the housing, and, wherein each second detent means may be selectively pivotally moved out of cooperation with the first detent means and each wrist support may be slid laterally as desired, the apparatus having the versatility wherein while using the keyboard, four modalities of adjustment are provided wherein the keyboard operator may secure both wrist supports at desired positions with respect to one another and with respect to the keyboard, may secure the one wrist support and slidably move the other wrist support, may slidably move the one wrist support and secure the other wrist support, and may slidably move both wrist supports independently of one another as desired, and wherein the means for securing and unsecuring each wrist support may be actuated by the thumb of one hand of the keyboard operator.

16. The wrist support apparatus of claim 15, further comprising a slot formed in the housing, the slot extending substantially the length of the housing, the wrist supports being mounted in the slot.

17. The wrist support apparatus of claim 15, further comprising the housing being connected to a platform, the platform having a substantially flat upper surface on which the keyboard is supported.

18. A wrist support apparatus to provide support and comfort and to reduce fatigue and possible injury to the wrists of a keyboard operator using a keyboard, the support comprising: a platform having a substantially flat upper surface on which the keyboard is supported, a pair of wrist supports to support the heel of the hand and the wrist adjoining thereto, each wrist support having a wrist pad having a convex upper surface on a respective upper end thereof; the wrist pads being cambered inwardly toward one another; each wrist support having a side opposite to the keyboard, a vertical post, a spring biased finger grip mounted on each wrist support on the respective wrist support on the side opposite to the keyboard, the respective finger grip releasably engaging each respective vertical post, means for connecting the wrist supports to the platform for vertical adjustment of the wrist supports individually with respect to the keyboard and with respect to one another wherein said vertical adjustment may be made by one hand of the keyboard operator by manually pulling the finger grip outwardly to disengage the finger grip from the vertical post substantially maintaining said hand on the respective wrist, and means for connecting the wrist supports to the platform for incremental and sliding lateral adjustment of the wrist supports individually with respect to the keyboard and with respect to one another; such that the keyboard operator may adjust each wrist support and each wrist pad individually to a desired position.

19. A wrist support apparatus to provide support and comfort and to reduce fatigue and possible injury to the wrists of a keyboard operator using a keyboard, the support comprising: a platform having a substantially flat upper surface on which the keyboard is supported; the platform having a front side having a length thereto, a plurality of laterally spaced-apart first detent means being disposed on the front side of the platform; a pair of wrist supports connected to the platform to support the heel of the hand and the wrist adjoining thereto; each wrist support having an upper end, each wrist support further having a member pivotally mounted thereon, the member projecting laterally therefrom, the member being substantially L shaped and including at least one leg having a second detent means thereon to selectively engage and disengage the first detent means on the front side of the platform such that each wrist support may be incrementally laterally adjusted with respect to the keyboard and with respect to the other wrist support; said last named means to engage and disengage the detent means on each wrist support being pivotably operable by one hand of the keyboard operator while maintaining said hand on the respective wrist support; means for vertical adjustment of the wrist supports with respect to the keyboard; a wrist pad mounted on the upper end of each wrist support, such that the keyboard operator may adjust the wrist supports and the wrist pads mounted thereon to a desired position.

20. A wrist support apparatus to provide support and comfort and to reduce fatigue and possible injury to the wrists of a keyboard operator using a keyboard, the support comprising: a platform having a substantially flat upper surface on which the keyboard is supported; the platform having a front side extending outwardly from the keyboard, the front side of the platform having a plurality of laterally spaced-apart first detent means thereon, a pair of separable, independent wrist supports connected to the platform to support the heel of the operator's hand and the wrist adjoining thereto, each wrist support having an upper end and a cushioned pad mounted on the respective upper end thereof, a lateral adjustment member pivotally mounted on the side of each wrist support, each lateral adjustment member projecting laterally and inwardly of the respective wrist support, a second detent means formed on each lateral adjustment member, wherein the lateral adjustment member on each wrist support may be manually pivoted by one hand of the keyboard operator while substantially maintaining said hand on the respective wrist support, and when the lateral adjustment member is pivoted the second detent means may selectively engage and disengage the first detent means on the front side of the platform permitting sliding lateral adjustment of each wrist support as desired, the apparatus having the versatility, wherein while using the keyboard, four modalities of lateral adjustment are provided wherein the keyboard operator may secure both wrist supports at desired positions with respect to one another and with respect to the keyboard, may secure the one wrist support and slidably move the other wrist support, may slidably move the one wrist support and secure the other wrist support, and may slidably move both wrist supports independently of one another as desired.

* * * * *